US012698115B1

(12) United States Patent
Malenke et al.

(10) Patent No.: US 12,698,115 B1
(45) Date of Patent: Aug. 4, 2026

(54) SYSTEMS AND METHODS FOR PACKAGING PRODUCTS USING CONVEYORS

(71) Applicant: Kraft Foods Group Brands LLC, Chicago, IL (US)

(72) Inventors: Mark E. Malenke, Lakeville, MN (US); Jessica Lynn Simpson, Chicago, IL (US); David J. Nonn, Luxemburg, WI (US); Charles Robert Sample, Suamico, WI (US)

(73) Assignee: Kraft Foods Group Brands LLC, Chicago, IL (US)

( * ) Notice: Subject to any disclaimer, the term of this patent is extended or adjusted under 35 U.S.C. 154(b) by 0 days.

(21) Appl. No.: 19/232,498

(22) Filed: Jun. 9, 2025

(51) Int. Cl.
*B65B 41/02* (2006.01)
*B65B 41/18* (2006.01)

(52) U.S. Cl.
CPC ..... *B65B 41/02* (2013.01); *B65B 41/18* (2013.01)

(58) Field of Classification Search
CPC ..... B65B 41/02; B65B 41/18; B65B 35/246; B65G 15/26
See application file for complete search history.

(56) References Cited

U.S. PATENT DOCUMENTS

2003/0033788 A1* 2/2003 Van Dam ..... B65G 57/06 53/541
2005/0207879 A1* 9/2005 Blackwell ..... B65H 31/3009 414/798.9
2013/0213201 A1* 8/2013 Malenke ..... B26D 7/32 83/111
2024/0400246 A1* 12/2024 Schindler ..... B65B 5/068

* cited by examiner

*Primary Examiner* — Thomas M Wittenschlaeger
(74) *Attorney, Agent, or Firm* — Fitch, Even, Tabin & Flannery LLP

(57) ABSTRACT

A multi-package automated conveyor-based packaging apparatus improves product packaging material placement accuracy in packaging machines. The apparatus includes a self-aligning infeed conveyor, an angled release mechanism, guided transfer belts, and a retractable noser conveyor with one or more multi-position gates. Product packaging materials are centered and precisely deposited within target placement areas. A control unit synchronizes the movement of various components of the apparatus, for example, the conveying surfaces and the gate(s) of the apparatus.

20 Claims, 9 Drawing Sheets

SYSTEMS AND METHODS FOR PACKAGING PRODUCTS USING CONVEYORS

TECHNICAL FIELD

This disclosure relates to package loading systems for packaging machines, more specifically, to package loading systems for loading packages onto conveyor-based packaging machines.

BACKGROUND

Conventional automated product loading systems typically fall into two categories: robotic and mechanical. Robotic systems offer flexibility in product placement, but may lack precision due to end-effector limitations. On the other hand, mechanical systems provide better product control but may be constrained in their ability to handle multiple product rows and tracks within a single indexing cycle. For example, conventional mechanical loaders may have various limitations with respect to maintaining precise product alignment during transfer, handling multi-row, multi-track configurations efficiently, and ensuring product handling that prevents contamination.

BRIEF DESCRIPTION OF DRAWINGS

Disclosed herein are embodiments of an apparatus and method for packaging products using conveyors. This description includes drawings, wherein.

Figure 1:
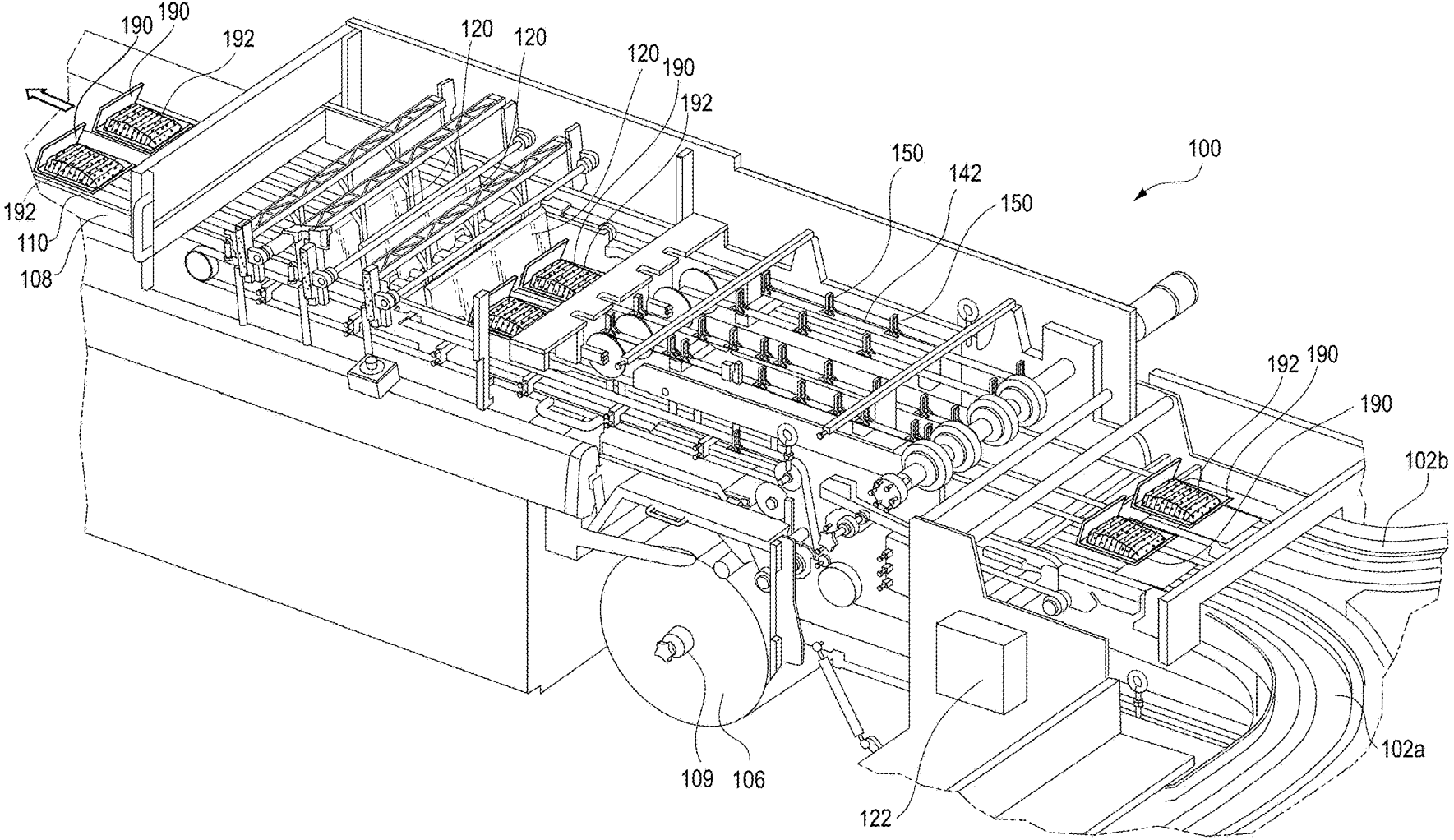
FIG. 1 shows a perspective view of a conveyor-based apparatus for packaging products in accordance with some embodiments.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments. Also, common but well-understood elements that are useful or necessary in a commercially feasible embodiment are often not depicted in order to facilitate a less obstructed view of these various embodiments. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

The following description is not to be taken in a limiting sense, but is made merely for the purpose of describing the general principles of exemplary embodiments. Reference throughout this specification to "one embodiment," "an embodiment," "some embodiments," "an implementation," "some implementations," "some applications," or similar language means that a particular feature, structure, or characteristic described in connection with the embodiment is included in at least one embodiment of the invention. Thus, appearances of the phrases "in one embodiment," "in an embodiment," "in some embodiments," "in some implementations," and similar language throughout this specification may, but do not necessarily, all refer to the same embodiment.

Generally speaking, pursuant to various embodiments, a multi-package automated loading system improves product placement accuracy in packaging machines. The system includes a self-aligning infeed conveyor, an angled release mechanism, guided transfer belts, and a retractable noser with multi-position gates. Products are precisely centered and deposited into multi-row packaging arrays without contamination. The control system synchronizes movements with downstream equipment, ensuring efficient and precise loading of products onto packaging materials.

In some embodiments, a conveyor-based apparatus for packaging products includes: a first conveying surface for supporting and conveying product packaging material in a first direction thereon; a second conveying surface for supporting and conveying the product packaging material in the first direction thereon, the second conveying surface oriented above and in parallel with the first conveying surface; a gate movable between an inactive position, where the gate does not obstruct movement of the product packaging material on the first conveying surface or on the second conveying surface, a first deployed position, where the gate obstructs movement of the product packaging material on the second conveying surface in the first direction, and a second deployed position, where the gate obstructs movement of the product packaging material on the first conveying surface in the first direction; and a control unit operatively coupled to the first conveying surface, the second conveying surface, and the gate. The control unit is configured to cause the second conveying surface to move in the first direction and cause the gate to move toward the second conveying surface and then, when the gate is in the first deployed position and a leading end of the product packaging material is in contact with the gate, the control unit causes the gate, and the second conveying surface to stop moving. The control unit is further configured to cause the gate to move toward the second conveying surface and cause the second conveying surface to move in a second direction opposite to the first direction to withdraw a portion of the second conveying surface from under the product packaging material such that the leading end of the product packaging material descends toward the first conveying surface while the leading end of the product packaging material remains in contact with the gate and while a trailing end of the product packaging material remains supported by the portion of the second conveying surface. In addition, after the gate is in the second deployed position and the product packaging material descends onto the first conveying surface, the control unit is configured to cause the gate to lift from the second deployed position toward the first deployed position and cause the first conveying surface to move in the first direction to advance the product packaging material past the gate and toward packaging equipment located downstream of the gate.

In some embodiments, a method of packaging products using conveyors includes: supporting and conveying product packaging material on a first conveying surface moving in a first direction; supporting and conveying the product packaging material on a second conveying surface moving in the first direction, the second conveying surface being oriented above and in parallel with the first conveying surface; and moving a gate between: an inactive position where the gate does not obstruct movement of the product packaging material on the first conveying surface of the second conveying surface; a first deployed position where the gate obstructs movement of the product packaging material on the second conveying surface in the first direction; and a second deployed position where the gate obstructs movement of the product packaging material on the first conveying surface in the first direction. The method further includes controlling the first conveying surface, the second conveying surface, and the gate via a control unit by: causing the second conveying surface to move in the first direction; causing the gate to move toward the second conveying surface, and, when the gate is in the first deployed position and a leading end of the product packaging material contacts the gate, stopping movement of the gate and the second conveying surface. The method further includes causing the gate to move toward the second conveying surface while causing the second conveying surface to move in a second direction opposite to the first direction to withdraw a portion of the second conveying surface from under the product packaging material and cause the leading end of the product packaging material to descend toward the first conveying surface while maintaining contact with the gate and while a trailing end remains supported by the portion of the second conveying surface. The method further includes, after the gate reaches the second deployed position and the product packaging material descends onto the first conveying surface, causing the gate to lift from the second deployed position toward the first deployed position while causing the first conveying surface to move in the first direction to advance the product packaging material past the gate toward downstream packaging equipment.

With reference to FIG. 1, an apparatus 100 is provided for packaging various products 192. In the embodiment illustrated in FIG. 1, the apparatus 100 includes two lanes 102*a*, 102*b*, each of which transports an array of product packaging materials 190 containing products 192 (in this example, a stack of sliced food products) thereon. It will be appreciated that the apparatus 100 may include less than two (i.e., one) lanes or more than two (three or more) lanes. While the example shown in FIG. 1 show the product 192 (which is depicted as a sliced food product) being conveyed by the two lanes 102*a*, 102*b* of the apparatus 100 while resting on and being supported by the food product packaging material 190 (which is depicted as a tray), it will be appreciated that, in some embodiments, products 192 (e.g., sliced or unsliced food products or non-food products) may be conveyed by two or more lanes of the apparatus 100 while not having any packaging material underneath and while resting directly on a conveying surface of the apparatus 100. In the example depicted in FIG. 1, the products 192 have been shown in the form of stacked meat (e.g., bacon) slices, but the apparatus 100 may be used to package other food products or products that are not food products, which may be arranged in a stacked configuration or a non-stacked configuration on their respective packaging materials. As used herein, the term "product packaging materials" is referred to one or more materials (e.g., a product tray, a film, etc.) that may be used in combination to package food products and/or non-food products that are offered for sale to customers.

In the embodiment shown in FIG. 1, the apparatus 100 includes a roll 106 of film 110 that is unwound in the machine direction (i.e., the direction of transport of the packaging materials 190 by the apparatus 100, which is indicated by an arrow in FIG. 1) over a support surface 108. In some aspects, as will be discussed in more detail below, the film 110 that is unwound over the support surface 108 from the film roll 106 provides a first conveying surface for supporting and conveying the product packaging materials 190 after the product packaging materials 190 are deposited from the front portion 154 (which is referred to herein as a second conveying surface) of the noser conveyor 152 onto the film 110. In certain aspects, the film 110 may be a multilayer laminate and may include materials, such as polyethylene (e.g., for sealing), nylon and/or polyester (e.g., for strength), ethylene vinyl alcohol (e.g., for restricting/preventing oxygen and moisture transmission).

As will be discussed in more detail below, in some aspects, the film 110 includes a target area 111 for depositing the product packaging material 190 from the noser conveyor 152 onto the film 110. In the embodiment shown in FIG. 5, the target area 111 is delineated by a visibly marked by a boundary line 113 that surrounds the target area 111. Since the product packaging material 190 illustrated in the drawings has a generally rectangular shape overall, the boundary line 113 has a complementary overall generally rectangular shape. However, in some aspects, the apparatus 100 is used to transport products and packaging materials of shapes that are not rectangular, and the boundary line 113 may have a different regular geometric shape (e.g., oval, triangle, etc.) or may have an irregular shape.

Figure 5:
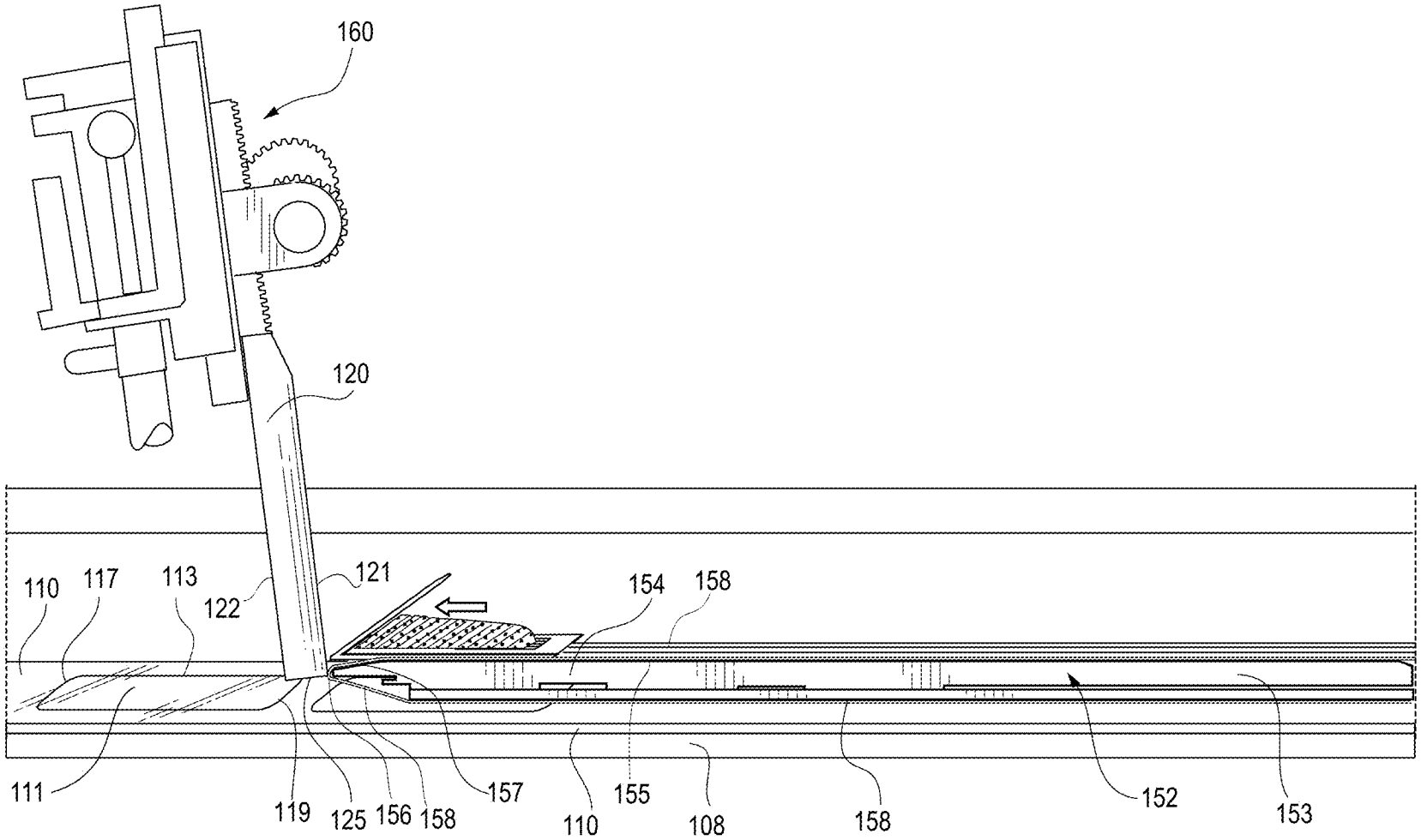
FIG. 5 shows a side fragmentary view of the apparatus of FIG. 1 showing a product-carrying packaging material arriving and stopping at a gate of the apparatus in accordance with some embodiments.

As will be discussed in more detail below, the apparatus 100 shown in FIG. 1 further includes a noser conveyor 152, the front portion 154 of which provides a second conveying surface for supporting and conveying the product packaging material 190 in the machine direction. In the illustrated embodiment, an upwardly-facing surface of the front portion 154 of the noser conveyor 152 is oriented above and in parallel with an upwardly facing surface of the film 110, as shown in FIG. 5. In some aspects, the speeds of movement of the noser conveyor 152 and the film 110 (as it is unrolled from the roll 106) may be synchronized, either by moving forward together at the same time or moving independently according to a predefined synchronization pattern, to ensure that the product packaging material 190 is precisely deposited from the noser conveyor 152 onto the film 110 within the target area 111 surrounded by the boundary line 113.

In the embodiment depicted in FIG. 1, the apparatus 100 includes a movable gate 120. The apparatus 100 shown by way of example in FIG. 1 includes three such movable gates 120. Since the apparatus 100 of FIG. 1 has two lanes 102*a*, 102*b* and three movable gates 120, six product-conveying product packaging materials 190 may be simultaneously loaded onto the film 110 from the noser conveyor 152. However, it will be appreciated that, depending on the size of the packaging facility where the apparatus 100 is deployed, the apparatus 100 may include only one movable gate 120, two movable gates 120, or four or more movable gates 120, which provides the apparatus 100 with an ability to simultaneously load less than six or more than six product packaging materials 190 onto the film 110 at one given time.

As will be described in detail below, each gate 120 is movable between an inactive position (shown in FIG. 8), where the gate 120 does not obstruct movement of the product packaging material 190 in the machine direction on the film 110 or on the noser conveyor 152, a first deployed position (shown in FIG. 5), where a bottom 125 of the gate 120 is in direct contact with the noser conveyor 152 and the gate 120 obstructs movement of the product packaging material 190 conveyed on the noser conveyor 152 in the machine direction, and a second deployed position (shown in FIG. 7), where the bottom 125 of the gate 120 is in direct contact with the film 110 being unwound from the roll 106 and the gate 120 obstructs movement of the product packaging material 190 conveyed on the film 110 in the machine direction.

In order to effectuate the directional movement of the product conveying surfaces of the apparatus 100 and the movement of the product packaging materials 190 thereon, the apparatus 100 shown in FIG. 1 includes a control unit 122 (e.g., a control box, etc.) operatively coupled (e.g., electrically) to, for example, the conveyors, belts, pneumatic actuators, drive shafts, gears, and other components of the apparatus 100 for controlling the movement of such components of the apparatus 100. In certain aspects, the control unit 122 may include a control circuit having a programmable processor. In one aspect, the control unit 122 may be operatively coupled to a computing device (e.g., a desktop computer, a laptop computer, a tablet, a mobile phone, or any other electronic device that may be configured for data entry and processing and for wired or wires communication with the control unit 122). While the control unit 122 is shown in FIG. 1 as being physically coupled to the apparatus 100, the control unit 122 may be physically separate from the apparatus 100 and may remotely control the apparatus via a wired or wireless connection.

In the illustrated embodiment, in addition to the first conveying surface (i.e., film 110) and the second conveying surface (i.e., front portion 154 of the noser conveyor 152) mentioned above, the apparatus 100 includes multiple conveying conveyors, belts, and other components that facilitate the transport of the product packaging materials 190 by the apparatus 100. In particular, the apparatus 100 shown in FIG. 1 includes an infeed conveyor 112 that includes two lanes 102*a*, 102*b*, with each of the lanes 102*a*, 102*b* transporting an array of spaced apart product packaging materials 190 conveying products 192 thereon. For simplicity of illustration, only two product packaging materials 190 are illustrated on the infeed conveyor 112 in FIG. 1, but it will be appreciated that dozens or hundreds of product packaging materials 190 having stacked or non-stacked products 192 thereon may be disposed in each one of the lanes 102*a*, 102*b* of the infeed conveyor 112.

In operation, a product packaging material 190 containing a product 192 (which, as mentioned above, may be a stack of multiple food products such as meat slices) is positioned on the infeed conveyor 112. In some aspects, the infeed conveyor 112 includes lugs 115 (which may be referred to herein as operator placement chain lugs) that are spaced apart by a distance that is greater than the overall length of the product packaging material 190, thereby creating "pockets" for placing the product packaging material 190 between the lugs 115. As such, during movement of the product packaging material 190 in the machine direction on the infeed conveyor 112, a first group (e.g., two or more) of leading lugs 115*a* is located forwardly (i.e., in the machine direction) relative to the product packaging material 190 and a second group (e.g., two or more) of trailing lugs 115*b* is located rearwardly (i.e., opposite to the machine direction) relative to the product packaging material 190.

In some aspects, while the product packaging material 190 is being transported by the infeed conveyor 112, a trailing end 193 of the product packaging material 190 may be spaced apart from, or in direct contact with, the trailing lugs 115*b* located rearwardly of the product packaging material 190. By the same token, a leading end 191 of the product packaging material 190 may be spaced apart from, or in direct contact with the leading lugs 115*a* located forwardly of the product packaging material 190. As such, the packaging material 190 may be restricted from shifting rearwardly on the infeed conveyor 112 past the group of the trailing lugs 115*b* while also being restricted from shifting forwardly on the infeed conveyor 112 past the group of the leading lugs 115*a*.

In the illustrated embodiment, the apparatus 100 includes drag-back belts 126, which run in parallel with the infeed conveyor 112 on opposite sides of the infeed conveyor 112. In the illustrated embodiment, the apparatus 100 includes two drag-back belts 126, but it will be appreciated that, depending on the number of lanes of the infeed conveyor 112, the apparatus may include one drag-back belt 126, or three or more drag-back belts 126.

In some aspects, the drag-back belts 126 register the product packaging material 190 coming in on the infeed conveyor 112 against the trailing lugs 115*b* of the infeed conveyor 112. To that end, in the example shown in FIG. 2, the drag-back belts 126 include lugs 127 (which may be referred to herein as drag-back belt lugs) that may drag/push/shift the product packaging material 190 being transported by the infeed conveyor 112 back into the correct (e.g., centered) position within the "pocket" located between the leading lugs 115*a* and the trailing lugs 115*b* of the infeed conveyor 112. In some embodiments, the control unit 122 sets the speeds of the infeed conveyor 112 and the drag-back belts 126 such that the drag-back belts 126 run at a reduced speed as compared to the infeed conveyor 112.

Figure 2:
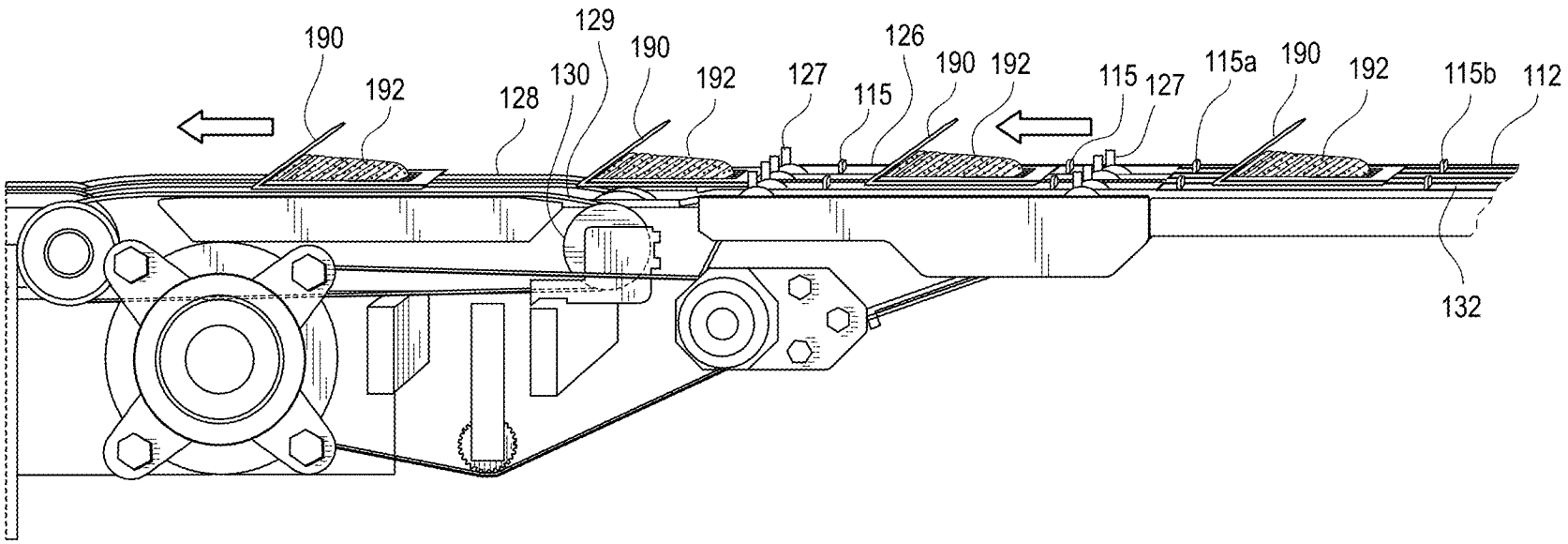
FIG. 2 shows a side fragmentary view of the apparatus of FIG. 1 showing product-carrying packaging materials moving along a section of the apparatus in accordance with some embodiments.

In the embodiment shown in FIG. 2, as the product packaging material 190 is traveling on the drag-back belts 126 section of the apparatus 100, the product packaging material 190 approaches a section including one or more accelerator belts 128 (which may be referred to herein as a fourth conveying surface and which is located upstream of the third conveying surface) located downstream of the drag-back belts 126. In some aspects, the accelerator belts 128 of the apparatus 100 pull the product packaging material 190 away from the infeed conveyor 112 to create clearance for the lugs 115*a*-115*b* as they go around a sprocket 130.

In some aspects, a trailing portion 129 of each accelerator belt 128 may include a pin or the like and is angled and oriented such that it fits into (adjacent to) the infeed conveyor 112, underneath an upwardly-facing surface 132 of the infeed conveyor 112 on which the product packaging material 190 are being conveyed. As the product packaging material 190 is being conveyed on the drag-back belts 126 of the apparatus 100, the product packaging material 190 is lifted, via the trailing portion 129 of the accelerator belts 128, from the infeed conveyor 112 onto the accelerator belts 128. The accelerator belts 128 then continue transporting the product packaging material 190 in the machine direction as shown, for example in FIG. 2. In some aspects, the accelerator belts 128 of the apparatus 100 are driven via a drive shaft 136 and rotate about a sprocket 138, as shown, for example, in FIG. 3.

Figure 3:
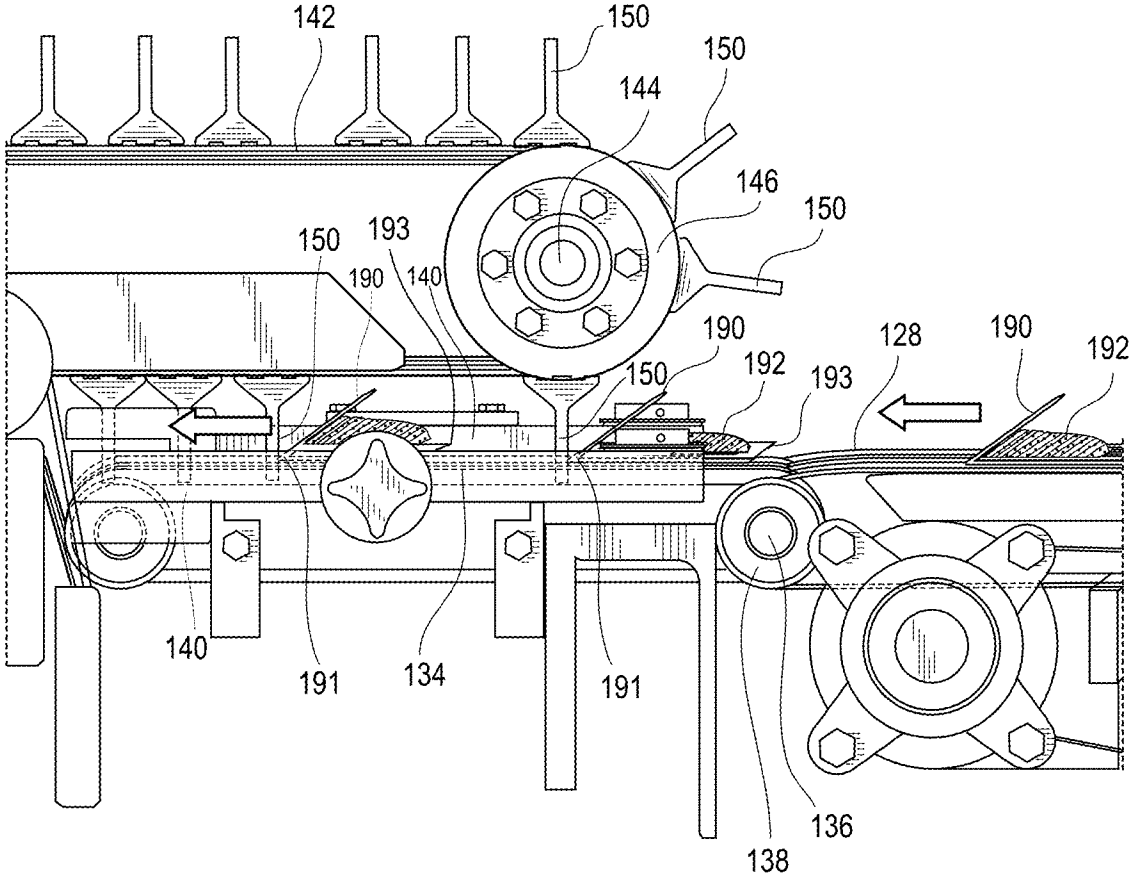
FIG. 3 shows a side fragmentary view of the apparatus of FIG. 1 showing the product-carrying packaging materials moving along another section of the apparatus in accordance with some embodiments.

In the embodiment shown in FIG. 3, as the product packaging material 190 is traveling on the accelerator belts 128 section of the apparatus 100, the product packaging material 190 approaches the transfer belts 134 (which may be referred to herein as a third conveying surface, and which is located upstream of the second conveying surface) of the apparatus 100. In some aspects, while the transfer belts 134 convey the product packaging material 190, the product packaging material 190 is centered on (i.e., properly positioned on a centerline of) the transfer belts 134. To facilitate the centering of the product packaging material 190 on the transfer belts 134, the apparatus 100 of FIGS. 3-4 includes two side shift belts 140 located on opposite sides of the transfer belts 134 and configured to rotate alongside the transfer belts 134 via, for example, a drive pulley and idler pulley combination.

In some embodiments, if the product packaging material 190 shifts off-center while traveling on the transfer belts 134 of the apparatus 100, a side of the product packaging material 190 may come in contact with a rotating side shift belt 140, which would then apply a force onto this side of the product packaging material 190 to push/shift the product packaging material 190 toward the center of its respective transfer belt 134, thereby "side-justifying" the product packaging material 190 and bringing the product packaging material 190 back to its intended centered position on the transfer belt 134. In some aspects, the side shift belts 140 rotate at a speed that is higher than the speed of rotation of the transfer belts 134.

Figure 4:
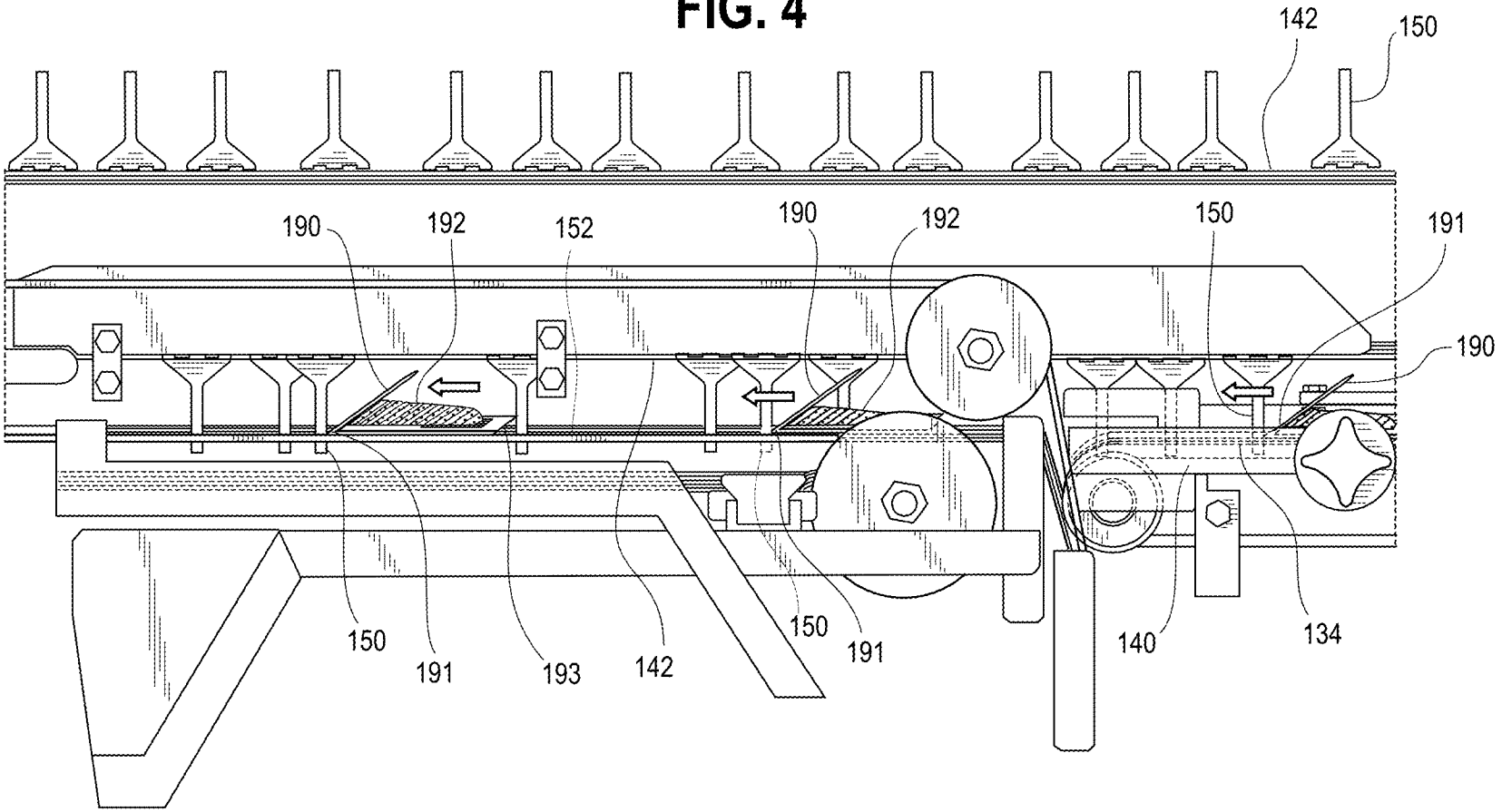
FIG. 4 shows a side fragmentary view of the apparatus of FIG. 1 showing the product-carrying packaging materials moving along yet another section of the apparatus in accordance with some embodiments.

In some aspects, while the transfer belts 134 convey the product packaging material 190, the product packaging material 190 is not simply centered (e.g., by virtue of the action of the side shift belts 140 as described above), but is also positioned at a predetermined pitch (i.e., spaced intervals) that may be complementary to the positions of the one of the one or more gates 120 and/or one or more target areas 111 associated with the film 110 of the apparatus 100. To that end, with reference to FIGS. 3-4, the apparatus 100 includes one or more positioning belts 142. In one aspect, the apparatus 100 includes four positioning belts 142, but it will be appreciated that the apparatus 100 may include less than four or more than four positioning belts 142. In some aspects, the positioning belt 142 of the apparatus 100 depicted in FIGS. 3-4 is driven via a drive shaft 144 and rotates about a pulley 146.

In the illustrated embodiment, a portion of the positioning belt 142 overlies at least a portion of the transfer belts 134 of the apparatus 100. As shown in FIGS. 3 and 4, the positioning belt 142 includes lugs 150 oriented transversely to the positioning belt 142 and extending therefrom. As mentioned above, in the illustrated embodiment, the lugs 150 of each positioning belt 142 are positioned at predetermined positions and intervals to ensure the alignment of the lugs 150 with the transfer belts 134 (and with the leading end 191 of the product packaging material 190 moving on the transfer belts 134) to facilitate the proper placement of the product packaging material 190 at the one or more gates 120 for the precise deposition of the product packaging material 190 within the target area 111 associated with the film 110. In certain aspects, the control unit 122 controls the speed of the drive shaft 144 to thereby set an appropriate/desired speed of rotation of the positioning belt 142.

In some embodiments, as the product packaging material 190 is traveling on the transfer belts 134 of the apparatus 100, the lugs 150 of the positioning belts 142 come into contact with the product packaging material 190 traveling on the transfer belts 134 to adjust a position of the product packaging material 190 on the transfer belts 134 and to adjust the position of the product packaging material 190 to set a predetermined pitch. In one example, shown in FIG. 3, as the product packaging material 190 transitions from the accelerator belts 128 to the transfer belts 134, the lugs 150 of the positioning belts 142 (which extend from the positioning belts 142 in the direction of the transfer belts 134) engage a leading end 191 of the product packaging material 190 on the transfer belts 134 and remain in abutment with the leading end 191 of the product packaging material 190 to retain the product packaging material 190 in a desired position (and at a desired pitch relative to the adjacent product packaging materials 190) while the product packaging material 190 is transported on the transfer belts 134 in the machine direction toward the gates 120.

In certain embodiments, as the product packaging material 190 is traveling on the transfer belts 134 of the apparatus 100, the product packaging material 190 arrives at the noser conveyors 152, which are located downstream of the transfer belts 134, and is transferred from the transfer belts 134 onto the belts of the noser conveyor 152. In certain aspects, when the product packaging material 190 transitions from the transfer belts 134 onto the noser conveyor 152, the lugs 150 of the positioning belts 142 (a portion of which overlies a portion of the belts of the noser conveyor 152) extend from the positioning belts 142 in the direction of the belts of the noser conveyor 152 and engage a leading end 191 of the product packaging material 190 on the belts of the noser conveyor 152 and remain in abutment with the leading end 191 of the product packaging material 190 to retain the product packaging material 190 in a desired position (and at a desired pitch) while the product packaging material 190 is transported on the belts of the noser conveyor 152 forwardly in the machine direction toward the gates 120.

In certain embodiments, the relative positions of the belts of the noser conveyor 152 and the positioning belts 142 are such that a front portion 154 (which is also referred herein as the second conveying surface) of the noser conveyor 152 extends forwardly in the machine direction past a front end of the positioning belts 142. As a result, the lugs 150 of the positioning belts 142 do not overlie the front portion 154 of the noser conveyor 152 and the lugs 150 of the positioning belts 142 disengage from the leading end 191 of the product packaging material 190 when the product packaging material 190 advances from the rear portion 153 of the noser conveyor 152 to the front portion 154 of the noser conveyor 152. In other words, the product packaging material 190 is conveyed on the front portion 154 of the noser conveyor 152 without being retained/guided by the lugs 150 of the positioning belts 142.

In certain embodiments, the front portion 154 of the noser conveyor 152 is movable between a retracted position (shown in FIG. 7) and an extended position (shown in FIG. 5). In some aspects, the movement of the noser conveyor 152 between the retracted position and the extended position is controlled (e.g., via one or more control signals) by the control unit 122.

In some aspects, when the product packaging material 190 is disposed on the front portion 154 of the noser conveyor 152, the control unit 122 transmits a control signal that causes the noser conveyor 152 to extend forward (i.e., in the machine direction), causing the front portion 154 (i.e., the second conveying surface) to move in a direction toward the gate 120 while overlying portions of the film 110 unwound from the roll 106 over the support surface 108. In some aspects, while the front portion 154 of the noser conveyor 152 is moving forward in the machine direction toward its fully extended position (shown in FIG. 5), the film 110 is not being actively unwound from the roll 106 (i.e., the roll 106 is stopped and the film 110 is not moving forward in the machine direction). In other aspects, while the front portion 154 of the noser conveyor 152 is moving forward in the machine direction toward its fully extended position (shown in FIG. 5), the film 110 is being actively unwound from the roll 106 at a speed that may be the same as or different from the speed of movement of the front portion 154 of the noser conveyor 152. As mentioned above, the gate 120 has a first side 121 and a second side 123 opposite of the first side 121.

In the illustrated embodiment, as the leading end 191 of the product packaging material 190 is conveyed by the forwardly extension of the noser conveyor 152 and approaches the gate 120, the control unit 122 transmits a signal (to a gate movement assembly 160 that may comprise a drive shaft/gear mechanism and/or a pneumatic actuator mechanism, or the like) that causes the gate 120 to move from its inactive position (shown in FIG. 8), where the gate 120 does not obstruct forward movement of the product packaging material 190 on the front portion 154 of the noser conveyor 152 (i.e., the second conveying surface) to a first deployed position (shown in FIG. 5), where the gate 120 obstructs the forward movement of the product packaging material 190 on the front portion 154 of the noser conveyor 152.

With reference to FIG. 5, in some aspects, as a result of the movement of the gate 120 from its retracted position to its first deployed position and the simultaneous movement of the noser conveyor 152 from its retracted position to its extended position, a leading end 156 of the noser conveyor 152 comes into contact with the first side 121 of the gate 120. In the example shown in FIG. 5, which depicts an embodiment of an apparatus 100 including only one gate 120, after the leading end 156 of the noser conveyor 152 abuts the first side 121 of the gate 120, the noser conveyor 152 is in its fully extended position, and further movement of the noser conveyor 152 in the machine direction is restricted. As shown in FIG. 5, the control unit 122 causes the gate 120 and the leading end 156 of the noser conveyor 152 to stop moving.

Figure 7:
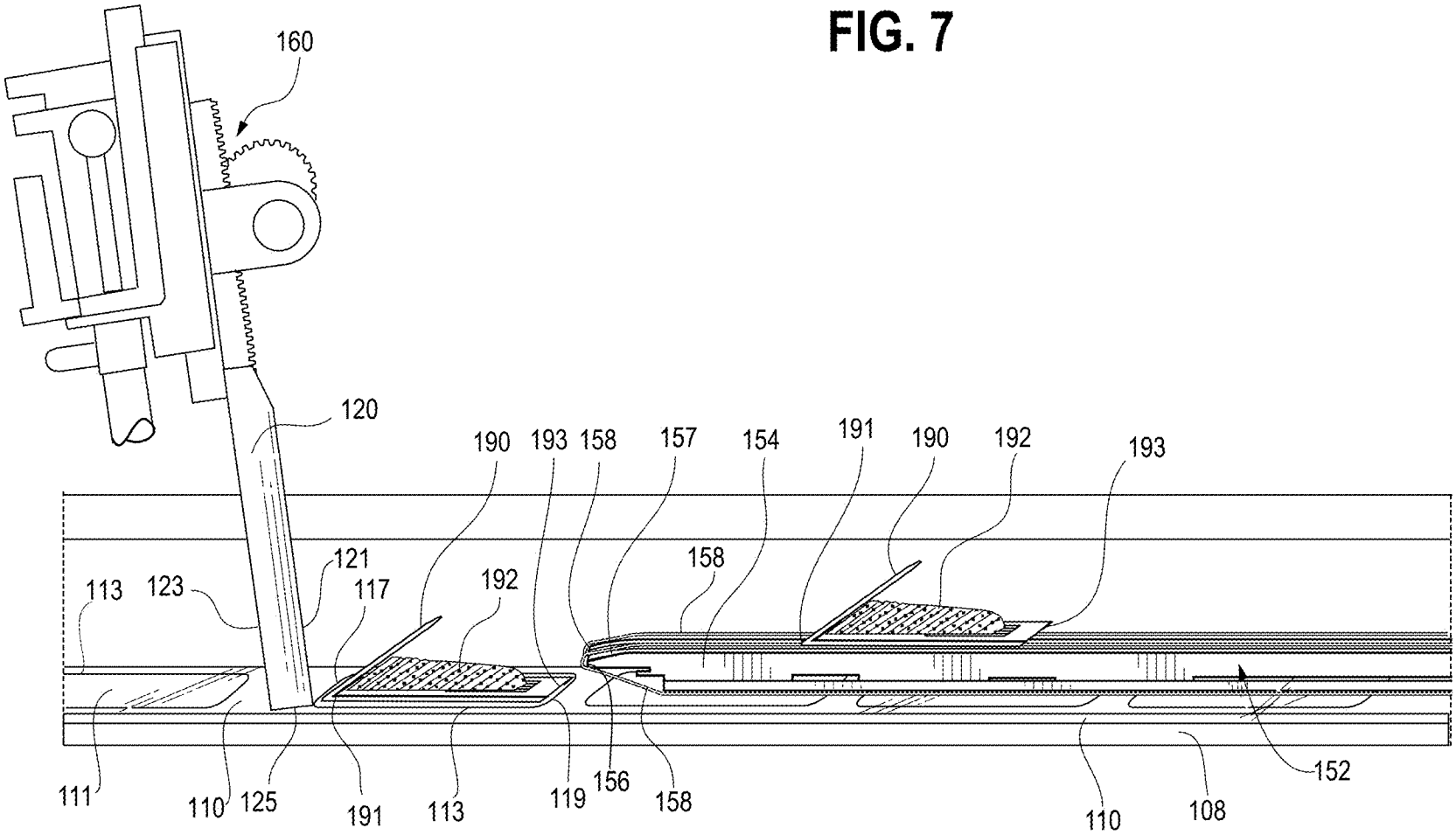
FIG. 7 shows the same view as in FIG. 6, but with the second conveying surface of the apparatus fully retracted rearwardly and the gate and the leading end of the packaging material being disposed on the first conveying surface of the apparatus in accordance with some embodiments.

As mentioned above, in some aspects, the forward movement of the film 110 in the machine direction is stopped prior to the noser conveyor 152 beginning its forward movement in the machine direction toward the fully extended position. In such aspects, the control unit 122 may send one or more signals to cause the gate 120 and the forward portion 154 of the noser conveyor 152 to stop moving when the leading end 156 of the noser conveyor 152 comes into contact with the first side 121 of the gate 120. In aspects, where the film 110 is actively moving in the machine direction (i.e., being unrolled from the roll 106) while the noser conveyor 152 is moving forward in the machine direction toward the fully extended position, the control unit 122 may send one or more signals that cause the gate 120 and the leading end 156 of the noser conveyor 152 and the film 110 to stop moving when the leading end 156 of the noser conveyor 152 comes into contact with the first side 121 of the gate 120. In one aspect, the control unit 122 stops the film 110 to position the film 110 such that a leading edge 117 of the boundary line 113 is substantially aligned with the first side 121 of the gate 120, thereby ensuring that, when the product packaging material 190 is deposited from the front portion 154 of the noser conveyor 152 within the target area 111, the leading end 191 of the product packaging material 190 is positioned adjacent to the leading edge 117 of the boundary line 113, the trailing end 191 of the product packaging material 190 is positioned adjacent to the trailing edge 119 of the boundary line 113, and the product packaging material 190 is fully contained within the boundary line 113 (as shown in FIG. 7).

In the illustrated embodiment, the noser conveyor 152 includes a helper belt 158 extending along the front portion 154 of the noser conveyor 152 and disposed such that a portion of the product packaging material 190 sits on the helper belt 158. In certain aspects, the product packaging material 190 is positioned on the helper belt 158 such that the helper belt 158 may convey the product packaging material 190 in the machine direction independently of the movement of the front portion 154 of the noser conveyor 152. For example, when the leading end 156 of the noser conveyor 152 comes into contact with the first side 121 of the gate 120 and stops, the leading end 191 of the product packaging material 190 is still spaced apart from (i.e., has not yet come in direct contact with) the first side 121 of the gate 120. However, while the leading end 156 of the noser conveyor 152 is in the fully extended position and stopped as shown in FIG. 5, the rotational movement of the helper belt 158 in the machine direction conveys the leading end 191 of the product packaging material 190 toward the gate 120 and into direct contact with the first side 121 of the gate 120, as shown in FIG. 5.

In the example shown in FIG. 5, which depicts the interaction of the noser conveyor 152 of the apparatus 100 with only one gate 120, after the leading end 156 of the noser conveyor 152 abuts the first side 121 of the gate 120, the noser conveyor 152 is in its fully extended position, further movement of the noser conveyor 152 in the machine direction is restricted, and the control unit 122 causes the gate 120 and the leading end 156 of the noser conveyor 152 to stop moving. As mentioned above, in some aspects, when the control unit 122 transmits one or more signals to cause the gate 120 and the leading end 156 of the noser conveyor 152 to stop moving, if the film 110 is also moving in the machine direction at this time by being unwound from the roll 106, the control unit 122 also transmits one or more signals to cause the film 110 to stop moving (i.e., the unwinding of the film 110 from the roll 106 in the machine direction is stopped).

Figure 6:
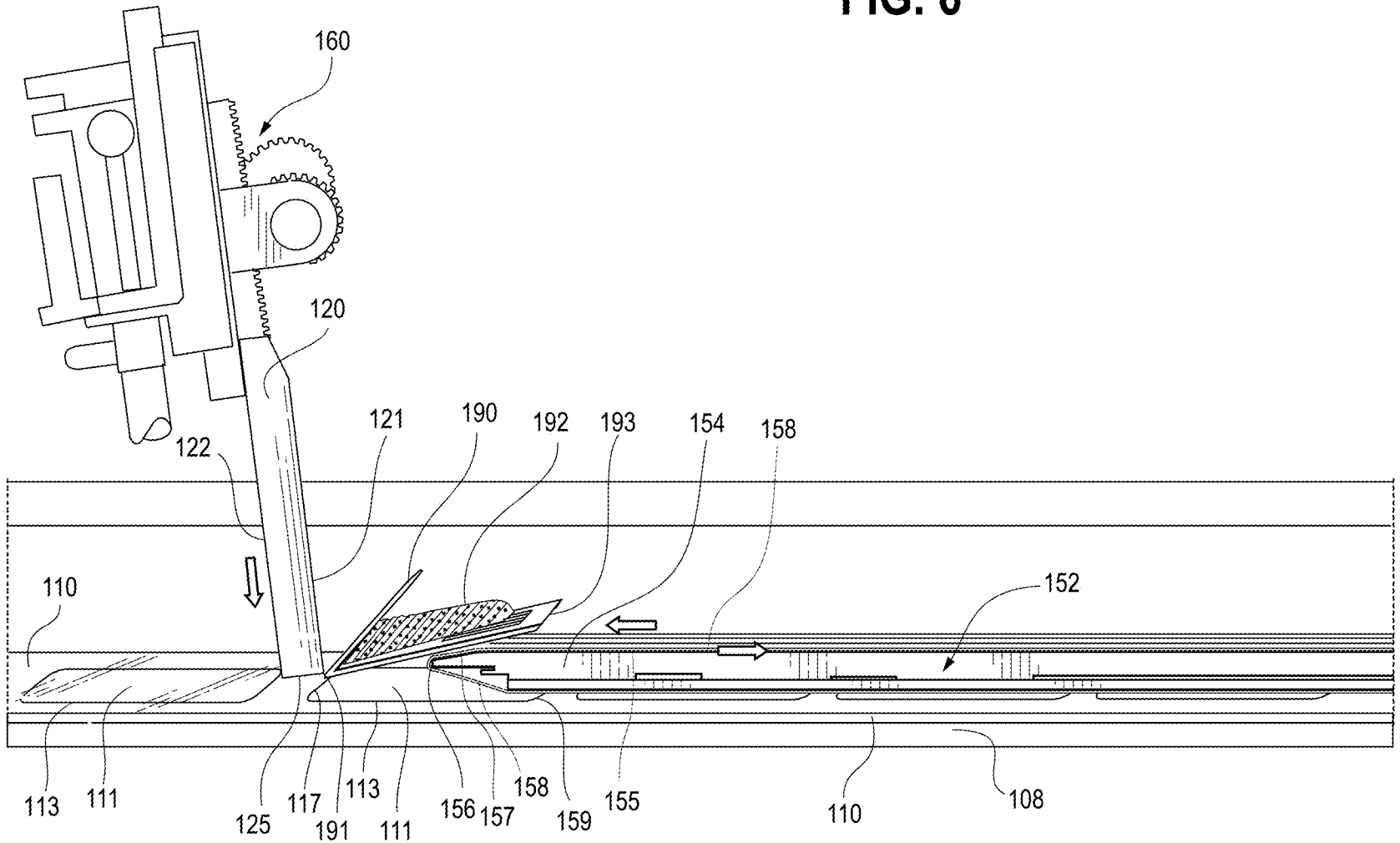
FIG. 6 shows the same view as in FIG. 5, but with a second conveying surface of the apparatus retracting rearwardly and the gate and the leading end of the product-carrying packaging material shifting downwardly toward a first conveying surface of the apparatus in accordance with some embodiments.

In the embodiment illustrated in FIGS. 5-6, the front portion 154 of the noser conveyor 152 includes a horizontal portion 155, a leading end 156, and a downwardly-tapered portion 157 extending from the horizontal portion 155 to the leading end 156. In some aspects, when the noser conveyor 152, gate 120, product packaging material 190, and the film 110 are all stopped in the positions shown in FIG. 5, the control unit 122 causes the front portion 154 (i.e., second conveying surface) of the noser conveyor 152 to move from the fully extended position toward the fully retracted position. At the same time, the control unit 122 causes the gate 120 to move (downwardly) in a direction toward its second deployed position, thus causing the product packaging material 190 to tilt such that the leading end 191 of the product packaging material 190 descends downwardly toward the film 110 while maintaining contact with the first side 121 of the downwardly-moving gate 120 (which prevents the leading end 191 of the product packaging material 190 from uncontrollably falling down), while the trailing end 193 of the product packaging material 190 remains supported by the horizontal portion 155 and/or the downwardly-tapered portion 157 of the front portion 154 of the noser conveyor 152, as shown in FIG. 6.

Notably, as the front portion 154 of the noser conveyor 152 starts retracting rearwardly (i.e., in a direction opposite to the machine direction), the product packaging material 190 and the products 192 disposed thereon do not retract rearwardly together with the front portion 154 of the noser conveyor 152. The reason for that is that, while the front portion 154 of the noser conveyor 152 retracts rearwardly, the helper belt 158 continues to rotate forwardly (i.e., in the machine direction) to keep the leading end 191 of the product packaging material 190 pressed against the first side 121 of the gate 120 as the gate descends downwardly toward the film 110.

In certain aspects, the gate 120, and, more specifically, the first side 121 of the gate 120, is oriented relative to the horizontal portion 155 of the noser conveyor 152 and the upwardly-facing surface of the film 110 at an angle that is not 90 degrees. In some implementations, this angle is selected to ensure that the first side 121 of the gate 120 maintains direct contact with and supports the leading end 191 of the product packaging material 190 as the leading end 191 of the product packaging material 190 tilts downward while the downwardly-tapered portion 157 of the noser conveyor 152 is withdrawing from under the leading end 191 of the product packaging material 190 and while the trailing end 193 of the product packaging material 190 is initially supported by the horizontal portion 155 and subsequently supported by the downwardly-tapered portion 157 of the noser conveyor 152 during the retraction of the noser conveyor 152 from its fully extended position (FIG. 5) to its fully retracted position (FIG. 7). In the embodiments shown in FIGS. 5-8, the gate 120 is oriented such that the first side 121 of the gate 120 intersects the upwardly-facing surface of the film 110 to form an obtuse angle (e.g., an angle that is, for example, between 90 and 100 degrees), while the second side 123 of the gate 120 intersects the upwardly-facing surface of the film 110 to form an acute angle (e.g., an angle that is, for example, between 80 and 90 degrees).

In some aspects, as the noser conveyor 152 keeps retracting rearwardly (i.e., in a direction opposite the machine direction) from the position shown in FIG. 6, the gate 120 and the product packaging material 190 keep descending onto the film 110 with the product packaging material 190 being in a tilted orientation (shown in FIG. 6) until the movement of the noser conveyor 152 toward the fully retracted position causes the downwardly-tapered portion 157 of the front portion 154 of the noser conveyor 152 to withdraw from (and to no longer support) the trailing end 193 of the product packaging material 190. This causes the trailing end 193 to shift downward and descend directly onto the film 110, as shown in FIG. 7. As discussed in more detail above, since the film 110 that is unwound from the roll 106 is stopped at a predetermined location that is complementary to the location where first side 121 of the gate and the leading end 156 of the front portion 154 of the noser conveyor 152 meet, and since the gate 120 is oriented at a specific angle relative to the noser conveyor 152 and to the film 110, when the gate 120 reaches its second deployed position (where the bottom 125 of the gate 120 directly contacts the film 110), the product packaging material 190 is precisely deposited from the noser conveyor 152 onto the film 110 in a flat orientation and within the target area 111 surrounded by the boundary line 113, as shown in FIG. 7.

Figure 8:
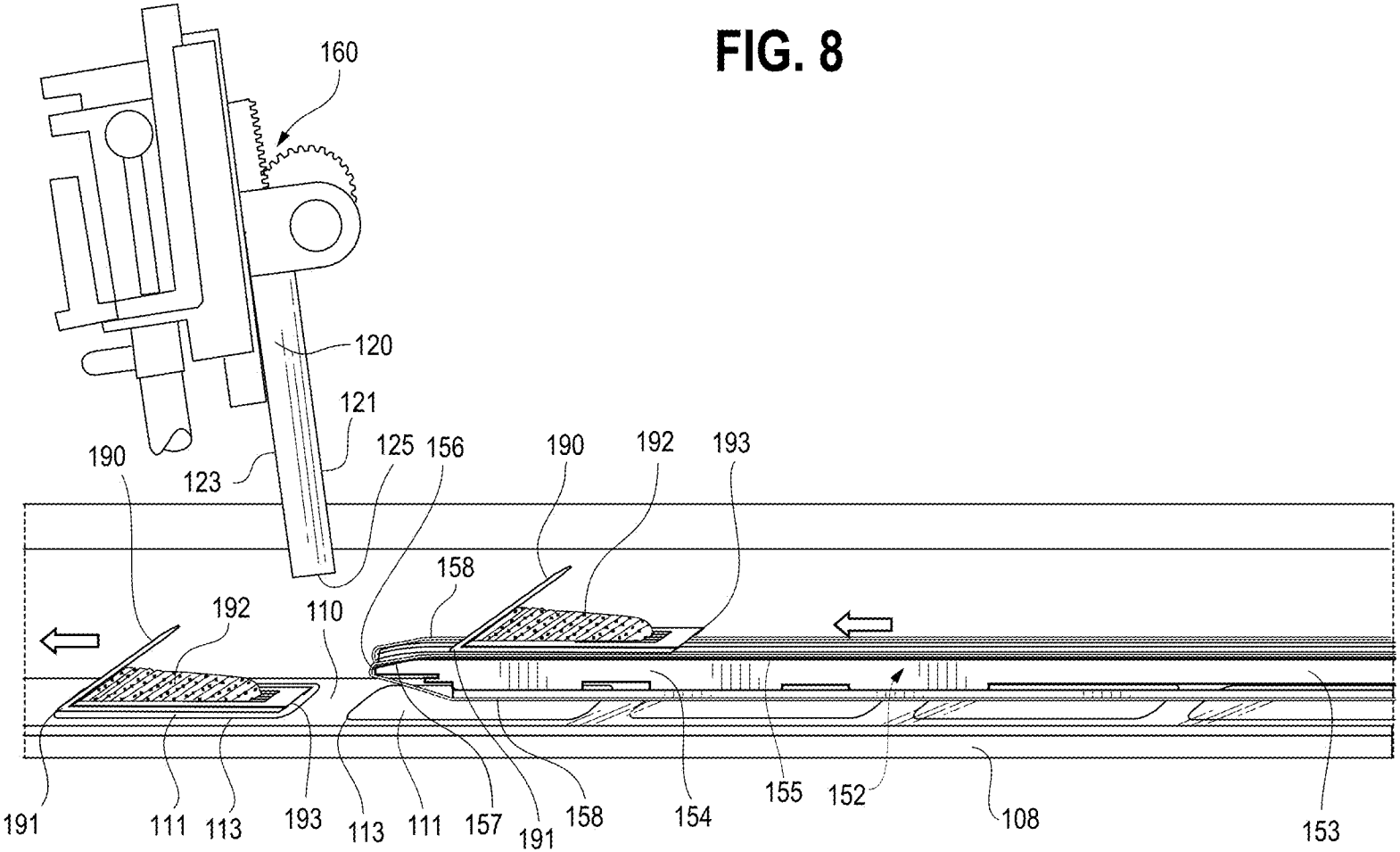
FIG. 8 shows the same view as in FIG. 7, but with the gate being shifted back up and the first conveying surface transporting the packaging material past the gate while the second conveying surface is moving forwardly toward the gate with the next product-carrying packaging material to be brought in contact with the gate in accordance with some embodiments.

In some aspects, after the gate 120 reaches its second deployed position shown in FIG. 7, and after the product packaging material 190 is precisely deposited in the flat orientation onto the film 110 within the target area 111 surrounded by the boundary line 113 as shown in FIG. 7, the control unit 122 causes, for example, by transmitting one or more signals to a (e.g., reciprocating) gate movement assembly 160, the gate 120 to lift the gate 120 from the second deployed position of FIG. 7 toward and past the first deployed position of FIG. 5 to its inactive position, where the bottom 125 of the gate 120 is located above both the film 110 and the noser conveyor 152, as shown in FIG. 8. In some aspects, as the gate 120 is moved by the gate movement assembly 160 from the second deployed position toward the inactive position, the control unit 122 causes, for example, by transmitting one or more signals to a film roll movement assembly 109, the film 110 to continue unwinding from the roll 106 to advance the product packaging material 190 past the gate 120 and in the machine direction toward downstream packaging equipment. In some aspects, the control unit 122 may also transmit one or more signals to the downstream packaging equipment to activate the downstream packaging equipment. In certain aspects, the downstream packaging equipment may deposit a second layer of film on top of the product packaging material 190 and seal this second layer of film to the film 110 to fully enclose and hermetically seal the product 192 within the product packaging material 190 (which may be referred to as a finished package that may be offered for sale to consumers).

Figure 9:
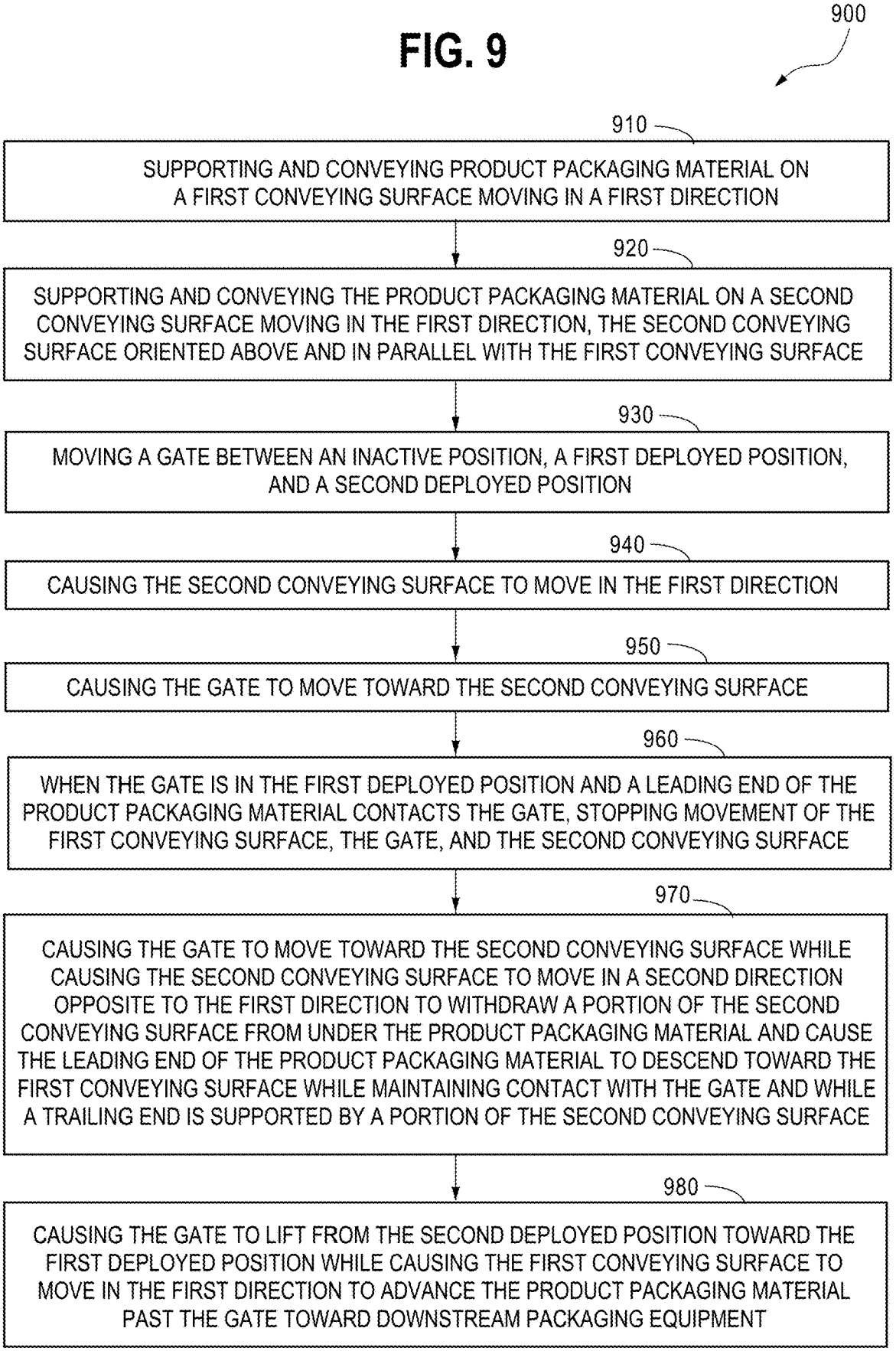
FIG. 9 shows a block diagram representing a method of packaging products using a conveyor-based apparatus in accordance with some embodiments.

FIG. 9 shows an embodiment of a method 900 of packaging products using a conveyor-based apparatus. In block 910, the method 900 includes supporting and conveying product packaging material on a first conveying surface moving in a first direction. As discussed above, the product packaging may have individual or stacked food products thereon.

In block 920, the method 900 further includes supporting and conveying the product packaging material on a second conveying surface moving in the first direction such that the second conveying surface is oriented above and in parallel with the first conveying surface. In some aspects, the first conveying surface and the second conveying surface run at a synchronized speed to ensure that the product packaging material is precisely deposited from the first conveying surface onto the second conveying surface within an area of the second conveying surface surrounded by a visible boundary line.

In block 930, the method 900 further includes moving a gate between several positions, namely. an active position, a first deployed position, and a second deployed position. In some aspects, as mentioned above, in the inactive position, the gate does not obstruct movement of the product packaging material in the machine direction on the first conveying surface or on the second conveying surface. In the first deployed position, the gate obstructs movement of the product packaging material on the second conveying surface in the machine direction. In the second deployed position, the gate obstructs movement of the product packaging material in the machine direction on the first conveying surface.

Blocks 940-980 of the method 900 involve various actions performed via a control unit that is configured to control the first conveying surface, the second conveying surface, and the gate. In particular, block 940 of the method 900 involves the control unit causing the second conveying surface to move in the first direction, and block 950 of the method 900 involves the control unit causing the gate to move toward the second conveying surface.

When the gate is in the first deployed position and a leading end of the product packaging material contacts the gate, block 960 of the method 900 involves the control unit stopping movement of the first conveying surface, the gate, and the second conveying surface. FIG. 5, discussed above, depicts the relative positions of the first conveying surface, the gate, the second conveying surface, and the packaging material upon completion of block 960 of the method 900.

In block 970, the method 900 includes the control unit causing the gate to move toward the second conveying surface while causing the second conveying surface to move in a second direction opposite to the first direction to withdraw a portion of the second conveying surface from under the product packaging material and cause the leading end of the product packaging material to descend toward the first conveying surface while maintaining contact with the gate and while a trailing end remains supported by the portion of the second conveying surface.

Finally, in block 980, after the gate reaches the second deployed position and the product packaging material descends onto the first conveying surface, the method 900 includes the control unit causing the gate to lift from the second deployed position toward the first deployed position while causing the first conveying surface to move in the first direction to advance the product packaging material past the gate toward downstream packaging equipment.

Generally speaking, the exemplary embodiments described herein advantageously provide automated loading systems for packaging machines that combine precise mechanical control with the ability to package arrays of products. For example, some of the embodiments described herein provide for automated, accurate, and efficient packaging of products (e.g., food products and products other than food products) using conveyor-based systems. Such product packaging systems ensure high-speed and precise packaging of multi-row product arrays, advantageously overcoming the above-discussed limitations of existing robotic and mechanical loaders used in conventional product packaging systems.

Those skilled in the art will recognize that a wide variety of other modifications, alterations, and combinations can also be made with respect to the above-described embodiments without departing from the scope of the invention, and that such modifications, alterations, and combinations are to be viewed as being within the ambit of the inventive concept.

The invention claimed is:

1. A conveyor-based apparatus for packaging products, the apparatus comprising:

a first conveying surface for supporting and conveying product packaging material in a first direction thereon;

a second conveying surface for supporting and conveying the product packaging material in the first direction thereon, the second conveying surface oriented above and in parallel with the first conveying surface;

a gate movable between an inactive position, where the gate does not obstruct movement of the product packaging material on the first conveying surface or on the second conveying surface, a first deployed position, where the gate obstructs movement of the product packaging material on the second conveying surface in the first direction, and a second deployed position, where the gate obstructs movement of the product packaging material on the first conveying surface in the first direction; and a control unit operatively coupled to the first conveying surface, the second conveying surface, and the gate, the control unit configured to:

cause the second conveying surface to move in the first direction;

cause the gate to move toward the second conveying surface;

when the gate is in the first deployed position and a leading end of the product packaging material is in contact with the gate, cause the gate and the second conveying surface to stop moving;

cause the gate to move toward the second conveying surface and cause the second conveying surface to move in a second direction opposite to the first direction to withdraw a portion of the second conveying surface from under the product packaging material such that the leading end of the product packaging material descends toward the first conveying surface while the leading end of the product packaging material remains in contact with the gate and while a trailing end of the product packaging material remains supported by the portion of the second conveying surface; and after the gate is in the second deployed position and the product packaging material descends onto the first conveying surface, cause the gate to lift from the second deployed position toward the first deployed position and cause the first conveying surface to move in the first direction to advance the product packaging material past the gate and toward packaging equipment located downstream of the gate.

2. The apparatus of claim 1, wherein the second conveying surface comprises a packaging film being unrolled in the first direction from a packaging film roll.

3. The apparatus of claim 1, wherein the second conveying surface includes a horizontal portion, a front end, and a downwardly-tapered portion extending from the horizontal portion to the front end.

4. The apparatus of claim 1, further comprising a third conveying surface located upstream of the second conveying surface and a fourth conveying surface located upstream of the third conveying surface, wherein, during the movement of the product packaging material in the first direction, the product packaging material moves on the fourth conveying surface and is then transferred from the fourth conveying surface onto the third conveying surface and is then transferred from the third conveying surface onto the second conveying surface.

5. The apparatus of claim 4, further comprising a positioning belt having a portion disposed over portions of the third second conveying surface and the second conveying surface, the positioning belt including a plurality of lugs oriented transversely to the positioning belt and extending therefrom in a direction toward the second conveying surface and the third conveying surface, wherein:

the positioning belt is operably coupled to a drive shaft: the control unit causes rotation of the drive shaft, thereby causing movement of the positioning belt; and during the movement of the positioning belt, the lugs of the positioning belt come into contact with the product packaging material being transported on the second conveying surface and the third conveying surface, thereby adjusting a position of the product packaging material on the second conveying surface and on the third conveying surface.

6. The apparatus of claim 4, further comprising a movable side shift belt coupled to at least one pulley and positioned on at least one side of the third conveying surface, wherein, during movement of the product packaging material on the third conveying surface, a side of the product packaging material comes into contact with the side shift belt, and the side shift belt adjusts a position of the product packaging material on the third conveying surface by shifting the product packaging material toward a centerline of the third conveying surface.

7. The apparatus of claim 4, wherein the fourth conveying surface includes a plurality of lugs extending upwardly therefrom, the lugs disposed on the fourth conveying surface at spaced intervals such that, during movement of the product packaging material in the first direction on the fourth conveying surface, a first group of the lugs is located forwardly relative to the product packaging material and a second group of the lugs is located rearwardly relative to the product packaging material to restrict the product packaging material from shifting forwardly past the first group and rearwardly past the second group.

8. The apparatus of claim 1, wherein:

when in the first deployed position, the gate is positioned such that a bottom of the gate is positioned in contact with the second conveying surface;

when in the second deployed position, the gate is positioned such that the bottom of the gate is positioned in contact with the first conveying surface; and when in the inactive position, the gate is positioned such that the bottom of the gate is positioned above the first conveying surface and above the second conveying surface.

9. The apparatus of claim 1, wherein the gate is coupled to a gate control assembly, the gate control assembly including one or more pneumatic actuators or one or more drive shafts and gears, the gate control assembly configured to receive a control signal from the control unit and move in response to the control signal, and wherein movement of the gate control assembly causes movement of the gate.

10. The apparatus of claim 1, wherein after the control unit cause the gate to lift from the second deployed position toward the first deployed position, the control unit transmits a signal that causes activation of the packaging equipment located downstream of the gate.

11. A method of packaging products using conveyors, the method comprising:

supporting and conveying product packaging material on a first conveying surface moving in a first direction;

supporting and conveying the product packaging material on a second conveying surface moving in the first direction, the second conveying surface being oriented above and in parallel with the first conveying surface;

moving a gate between:

an inactive position where the gate does not obstruct movement of the product packaging material on the first conveying surface of the second conveying surface;

a first deployed position where the gate obstructs movement of the product packaging material on the second conveying surface in the first direction; and a second deployed position where the gate obstructs movement of the product packaging material on the first conveying surface in the first direction; and controlling the first conveying surface, the second conveying surface, and the gate via a control unit by:

causing the second conveying surface to move in the first direction;

causing the gate to move toward the second conveying surface;

when the gate is in the first deployed position and a leading end of the product packaging material contacts the gate, stopping movement of the gate and the second conveying surface;

causing the gate to move toward the second conveying surface while causing the second conveying surface to move in a second direction opposite to the first direction to withdraw a portion of the second conveying surface from under the product packaging material and cause the leading end of the product packaging material to descend toward the first conveying surface while maintaining contact with the gate and while a trailing end remains supported by the portion of the second conveying surface; and after the gate reaches the second deployed position and the product packaging material descends onto the first conveying surface, causing the gate to lift from the second deployed position toward the first deployed position while causing the first conveying surface to move in the first direction to advance the product packaging material past the gate toward downstream packaging equipment.

12. The method of claim 11, wherein the second conveying surface comprises a packaging film, and further comprising unrolling the packaging film in the first direction from a packaging film roll.

13. The method of claim 11, wherein the second conveying surface includes a horizontal portion, a front end, and a downwardly-tapered portion extending from the horizontal portion to the front end.

14. The method of claim 11, further comprising:

conveying the product packaging material on a third conveying surface located upstream of the second conveying surface and on a fourth conveying surface located upstream of the third conveying surface; and during movement of the product packaging material in the first direction, transferring the product packaging material from the fourth conveying surface to the third conveying surface, and then transferring the product packaging material from the third conveying surface to the second conveying surface.

15. The method of claim 14, further comprising:

moving a positioning belt disposed over portions of the third and second conveying surfaces, the positioning belt including transversely oriented lugs extending toward the second and third conveying surfaces;

rotating a drive shaft coupled to the positioning belt to cause the moving of the positioning belt; and adjusting the position of the product packaging material on the second and third conveying surfaces by contacting the product packaging material with the lugs during the moving of the positioning belt.

16. The method of claim 14, further comprising:

adjusting a position of the product packaging material on the third conveying surface by contacting a side of the product packaging material with a movable side shift belt positioned adjacent the third conveying surface; and shifting the product packaging material toward a centerline of the third conveying surface.

17. The method of claim 14, wherein the fourth conveying surface includes upwardly extending lugs spaced at intervals, the method further comprising restricting movement of the product packaging material on the fourth conveying surface by positioning a first group of lugs forwardly and a second group of lugs rearwardly relative to the product packaging material.

18. The method of claim 11, wherein:

in the first deployed position, the gate contacts the second conveying surface;

in the second deployed position, the gate contacts the first conveying surface; and in the inactive position, the gate is positioned above both the first and second conveying surfaces.

19. The method of claim 11, further comprising:

coupling the gate to a gate control assembly, the gate control assembly including one or more pneumatic actuators or one or more drive shafts and gears; and moving the gate control assembly in response to a control signal to cause movement of the gate.

20. The method of claim 11, further comprising, after lifting the gate from the second deployed position toward the first deployed position, transmitting a signal by the control unit to activate the downstream packaging equipment.

* * * * *